US011377174B2

(12) United States Patent
Bech

(10) Patent No.: US 11,377,174 B2
(45) Date of Patent: Jul. 5, 2022

(54) MOORING SYSTEM

(71) Applicant: Can Systems AS, Arendal (NO)

(72) Inventor: Arild Bech, Arendal (NO)

(73) Assignee: Can Systems AS, Arendal (NO)

( * ) Notice: Subject to any disclaimer, the term of this patent is extended or adjusted under 35 U.S.C. 154(b) by 5 days.

(21) Appl. No.: 16/768,239

(22) PCT Filed: Dec. 7, 2018

(86) PCT No.: PCT/NO2018/050306

§ 371 (c)(1),
(2) Date: May 29, 2020

(87) PCT Pub. No.: WO2019/112444

PCT Pub. Date: Jun. 13, 2019

(65) Prior Publication Data

US 2020/0361569 A1 Nov. 19, 2020

(30) Foreign Application Priority Data

Dec. 8, 2017 (NO) ..... 20171967

(51) Int. Cl.

| | |
|---|---|
| ***B63B 21/00*** | (2006.01) |
| ***B63B 21/50*** | (2006.01) |
| ***B63B 25/12*** | (2006.01) |

(52) U.S. Cl.

CPC ..... *B63B 21/00* (2013.01); *B63B 21/50* (2013.01); *B63B 25/12* (2013.01)

(58) Field of Classification Search

CPC ..... B63B 21/00; B63B 21/50; B63B 25/12
See application file for complete search history.

(56) References Cited

U.S. PATENT DOCUMENTS 5,884,576 A * 3/1999 Wajnikonis ..... B63B 21/50 114/293
6,125,560 A * 10/2000 Beaumont ..... E02F 5/107 37/344

(Continued)

FOREIGN PATENT DOCUMENTS

GB 1595045 A * 8/1981 ..... B63B 22/021
GB 1595045 A 8/1981

(Continued)

OTHER PUBLICATIONS

PCT/NO2018/050306, International Search Report and Written Opinion, dated Feb. 28, 2019, 8 pages.

(Continued)

*Primary Examiner* — Lars A Olson
*Assistant Examiner* — Jovon E Hayes
(74) *Attorney, Agent, or Firm* — Kilpatrick Townsend & Stockton LLP

(57) ABSTRACT

A mooring system comprises a pair of first mooring elements configured at first ends for connection to a floating vessel, and a pair of second mooring elements configured at first ends for connection to a seabed below a water surface. A restrictor member is connected between said pair of first mooring elements' second ends. The restrictor member has a length dimension that is less than or equal to the width of the vessel to which the mooring system is connected.

17 Claims, 4 Drawing Sheets

(56) References Cited

U.S. PATENT DOCUMENTS

| | | | | |
|---|---|---|---|---|
| 6,216,628 | B1 * | 4/2001 | Poldervaart | B63B 21/50 114/230.2 |
| 6,435,124 | B1 * | 8/2002 | Williams | B63B 27/24 114/230.1 |
| 7,516,713 | B1 * | 4/2009 | Franta | B63B 21/50 114/230.26 |
| 2008/0006196 | A1 * | 1/2008 | Poldervaart | B63B 21/00 114/230.2 |
| 2020/0039610 | A1 * | 2/2020 | Liu | B63B 27/34 |
| 2020/0361569 | A1 * | 11/2020 | Bech | B63B 25/12 |

FOREIGN PATENT DOCUMENTS

| | | | | |
|---|---|---|---|---|
| WO | 2015/041916 | A1 | 3/2015 | |
| WO | WO-2015-212100 | * | 3/2015 | B63B 21/50 |

OTHER PUBLICATIONS

NO20171967, Norwegian Search Report, dated Jun. 11, 2018, 2 pages.

* cited by examiner

MOORING SYSTEM

CROSS REFERENCE TO RELATED APPLICATION

This application is a national stage application, filed under 35 U.S.C. § 371, of International Patent Application No. PCT/NO2018/050306, filed Dec. 7, 2018, which claims priority to Norwegian Patent Application No. 20171967, filed Dec. 8, 2017, both of which are incorporated by reference herein in their entirety.

FIELD OF THE INVENTION

The invention concerns a mooring system as set out by the preamble of claim 1.

BACKGROUND OF THE INVENTION

There is a need for a mooring system suited for shallow waters which is simpler and easier to install than the present systems, while at the same time fulfills operational requirements.

In shallow waters, e.g. down to less than 20 metres, and where wind and waves are relatively benign and directional, the well-known turret option is too elaborate and unnecessary. Typical data may be:

| | |
|---|---|
| Waves | $H_s$ 3.3 m/$T_p$ 12-18 s (swell dominated) |
| Wind | 20 m/s wind (1 hour mean) |
| Current | 0.5-1 m/s surface currents. |

A mooring system that keeps the vessel (e.g. a Floating Storage and Regasification Unit; FSRU) orientated with a fixed heading towards the dominating wave direction, and maintained on heading by stern holdback lines, is considered adequate. However, the mooring system must allow a cargo vessel, e.g. an LNG carrier (LNGC) to be moored alongside the FSRU during LNGC loading operations. A problem with known catenary mooring systems is that the mooring lines tend to interfere with large vessels (such as an LNGC) that intend to moor alongside the FSRU.

SUMMARY OF THE INVENTION

The invention is set forth and characterized in the main claim, while the dependent claims describe other characteristics of the invention.

It is thus provided a mooring system, comprising a pair of first mooring elements configured at first ends for connection to a floating vessel; a pair of second mooring elements configured at first ends for connection to a seabed below a water surface; characterized by a restrictor member connected between said pair of first mooring lines' second ends.

In one embodiment, the restrictor member is connected between said pair of second mooring elements' second ends. The restrictor member may be an inelastic member and the pairs of first and second mooring elements are connected to the restrictor member at opposite ends of the restrictor member. The restrictor member has a length dimension between said ends that is less than or equal to the width of the vessel to which the mooring system is connected, whereby the a pair of first mooring lines are pulled together and will not interfere with other vessels moored alongside said vessel. The restrictor member may be a stiff member, such as a steel rod, pipe or bar, or one or more chains or ropes.

A mooring system may comprise a floating vessel, a mooring system according to the invention connected to the bow portion of the floating vessel; and a mooring system according to the invention connected to the stern portion of the floating vessel.

The invented mooring system, referred to as a Restricted Catenary Mooring (RCM) system is particularly suited for shallow water application in benign areas with directional waves (swell). The RCM system is an effective mooring system which together with holdback mooring lines act as a spread mooring system.

The invented mooring system contributes to holding the mooring lines together and away from side-by-side moored LNGC.

The invented mooring system shall not be limited to use on an FSRU, but may be used on other vessels, such as FPSO and FSO vessels, and other ships.

BRIEF DESCRIPTION OF THE DRAWINGS

These and other characteristics of the invention will become clear from the following description of a preferential form of embodiment, given as a non-restrictive example, with reference to the attached schematic drawings, wherein.

DETAILED DESCRIPTION OF A PREFERENTIAL EMBODIMENT

Figure 1:
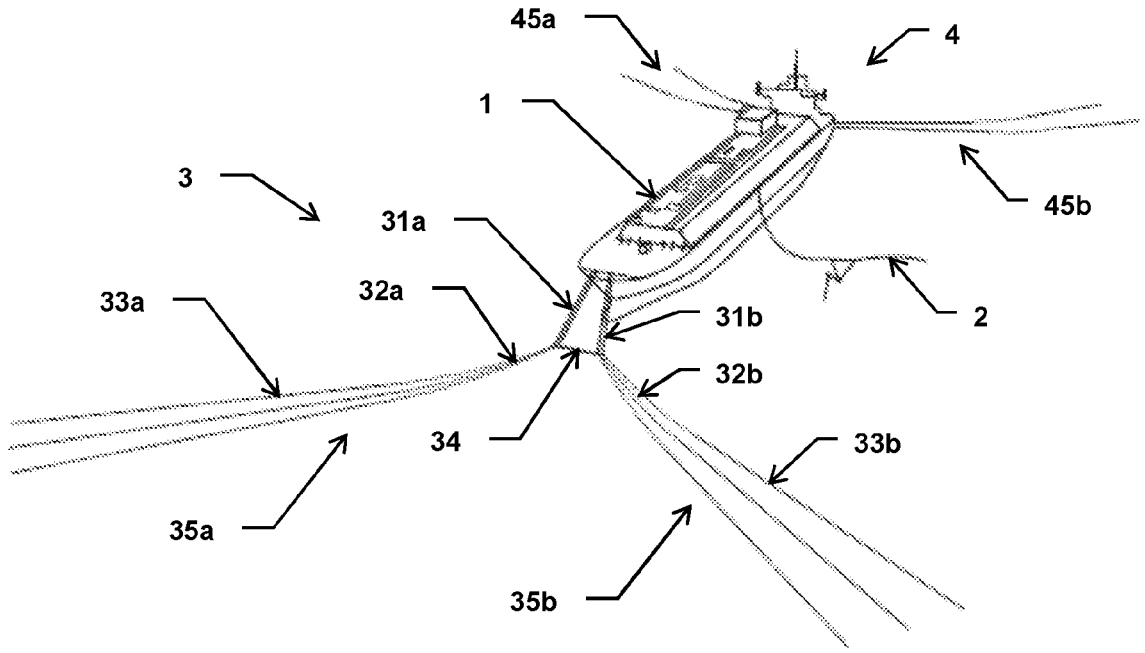
FIGS. 1 and 2 are perspective views of an embodiment of the invented mooring system, in use for mooring a floating vessel.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 shows an embodiment of the invented mooring system, in use for mooring a floating vessel 1, for example a Floating Storage and Regasification Unit (FSRU) ship 1. An export gas riser 2 is routed from a balcony along one side of the ship 1. An umbilical (not shown) may be included for control and operation of a seabed Pipeline End Manifold (PLEM; not shown). The umbilical may be stand-alone or piggy-backed to the riser (preferred).

In the illustrated embodiment, the ship 1 is moored via a bow mooring system 3 and a stern (hold-back) mooring system 4. The bow mooring system 3 and the stern mooring system 4 may in principle be similar (and thus generally be referred to as a "mooring system").

The bow mooring system 3 comprises in the illustrated embodiment two upper mooring elements 31*a*, 31*b*. Each of the upper mooring elements is at one end connected to the ship's 1 bow portion in a manner which is well known in the art (e.g. to winches on the ship's deck). The upper mooring elements 31*a*, 31*b* may comprise wires, ropes, lines, chains, or any other flexible mooring element known in the art. In the embodiment illustrated in FIG. 4, each upper mooring element 31*a*, 31*b* comprises three mooring chains, but the invention shall not be limited to this number or type of mooring element.

Each upper mooring element 31*a*, 31*b* is at its other end connected to generally opposite ends of an elongate element 34 which in the following will be referred to as a mooring restrictor. Also connected to (and generally at opposite ends of) the mooring restrictor 34, are two lower mooring elements 35*a*, 35*b*. These lower mooring elements are connected between the mooring restrictor 34 and respective seabed anchors (not shown) and extend in a catenary fashion in the body of water. The mooring elements 35*a*, 35*b* may comprise wires, ropes, lines, chains, or any other flexible mooring element known in the art.

Figure 2:
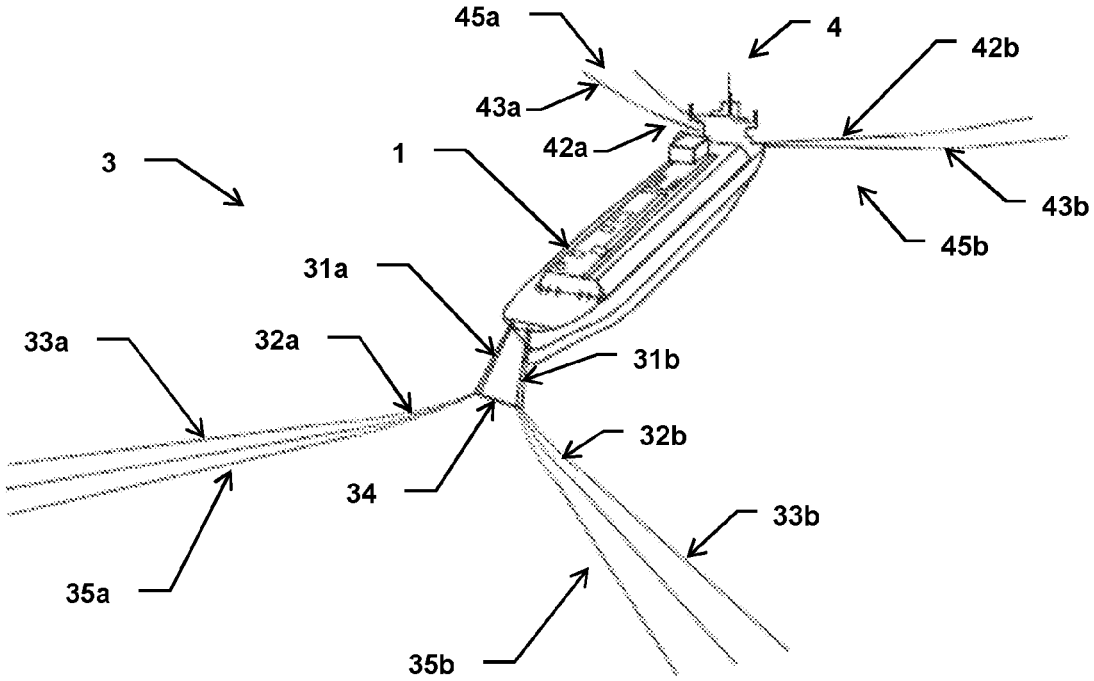
Figure 3:
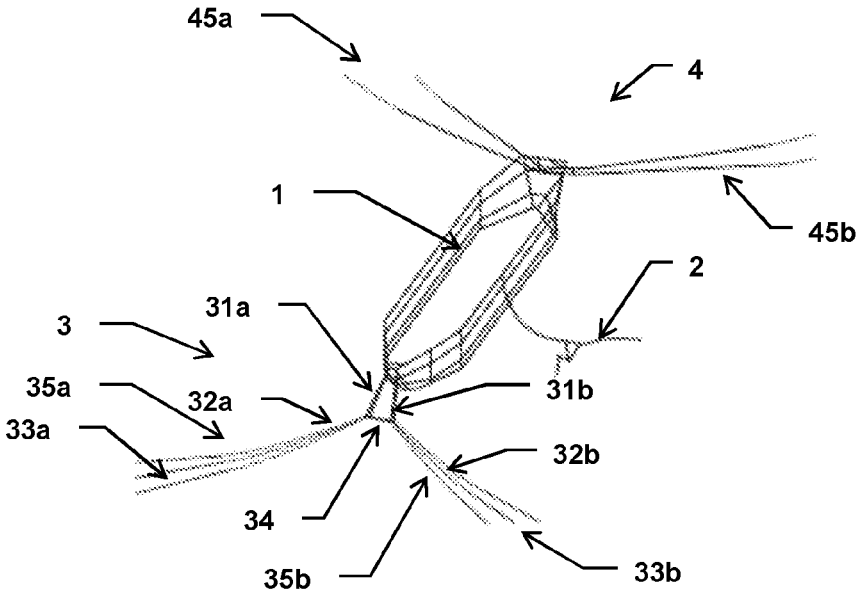
FIG. 3 is a perspective schematic sketch corresponding to FIGS. 1 and 2.

In the illustrated embodiment, each lower mooring element 35*a*, 35*b* comprises a first section 32*a*, 32*b* that may comprise synthetic fibre ropes (e.g. polyester) and a second section 33*a*, 33*b* that comprises chains and extend to the seabed anchors. FIGS. 1-3 show that each lower mooring element 35*a*, 35*b* comprises three elements (lines, ropes, chains, etc.), but the invention shall not be limited to this number or type of mooring element.

The stern mooring system 4 comprises in the illustrated embodiment two upper mooring elements 41*a*, 41*b*. Each of the upper mooring elements is at one end connected to the ship's 1 stern portion in a manner which is well known in the art (e.g. to winches on the ship's deck). The upper mooring elements 41*a*, 41*b* may comprise wires, ropes, lines, chains, or any other flexible mooring element known in the art. In the embodiment illustrated in FIG. 5, each upper mooring element 41*a*, 41*b* comprises two mooring chains, but the invention shall not be limited to this number or type of mooring element.

Each upper mooring element 41*a*, 41*b* is at its other end connected to generally opposite ends of an elongate element 44 which in the following will be referred to as a mooring restrictor. Also connected to (and generally at opposite ends of) the mooring restrictor 44, are two lower mooring elements 45*a*, 45*b*. These lower mooring elements are connected between the mooring restrictor 44 and respective seabed anchors (not shown) and extend in a catenary fashion in the body of water. The mooring elements 45*a*, 45*b* may comprise wires, ropes, lines, chains, or any other flexible mooring element known in the art.

In the illustrated embodiment, each lower mooring element 45*a*, 45*b* comprises a first section 42*a*, 42*b* that may comprise synthetic fibre ropes (e.g. polyester) and a second section 43*a*, 43*b* that comprises chains and extend to the seabed anchors. FIGS. 1-3 show that each lower mooring element 45*a*, 45*b* comprises three elements (lines, ropes, chains, etc.), but the invention shall not be limited to this number or type of mooring element.

Figure 4:
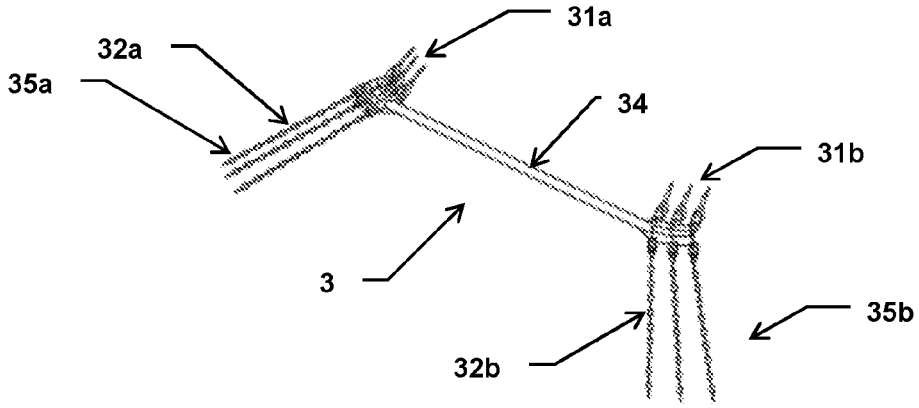
FIG. 4 is a perspective view of an embodiment of a bow mooring restrictor.
Figure 5:
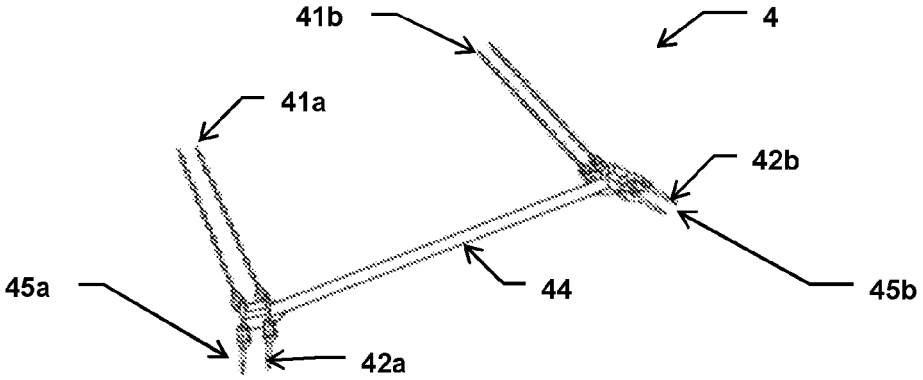
FIG. 5 is a perspective view of an embodiment of a stern mooring restrictor.

FIG. 4 illustrates an embodiment of the mooring restrictor 34, which serves to hold the mooring lines together, in order to avoid interference with any ship moored alongside the ship 1 (See e.g. FIG. 11, described below). The system comprises a restrictor triangle having a bar (the mooring restrictor) with the leeward lines relocated to point forward, resulting in a 3+3 bow mooring line configuration in the illustrated embodiment. The horizontal motions at the mooring restrictor are small. The Restricted Catenary Mooring (RCM) may be split in the following key components:

- Mooring hang-off at deck level
- Handling equipment
- Upper mooring hang-off
- The mooring, 3+3 lines assumed with fluke anchors.
- The mooring restriction (The Restrictor Bar) close to the bow/stern.
- A riser with PLEM for gas pipeline to shore and an umbilical for PLEM control FIG. 5 shows an embodiment of a mooring restrictor 44 for the stern holdback lines in a stern RCM system 4. These lines may be similar to the bow mooring, but with e.g. 2+2 lines if weather permits. See also FIG. 11. The upper part (above the restrictor) is chains, while the first portion of the lower lines are suggested to be buoyant polyester ropes in order to avoid interference with the existing pipelines and/or provide flexibility into the lines.

The mooring restrictors 34, 44 may be made from a reinforced pipe structure with a pad eye structure at each end. The mooring lines are attached with H-links.

Figure 6:
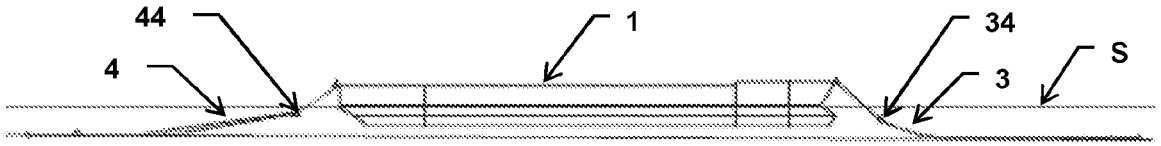
FIG. 6 is a side view schematic sketch illustrating the invented mooring system in a mooring state in equilibrium.

FIG. 6 shows the ship 1 and the mooring system according to the invention in a state of equilibrium. Reference letter S denotes the water surface. Note that the mooring restrictors 34, 44 are located below and near the water surface S.

Figure 7:
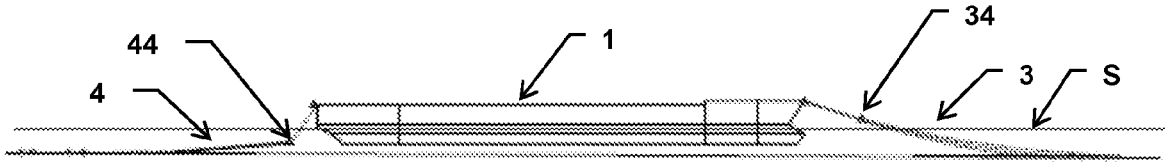
FIG. 7 is a side view schematic sketch illustrating the invented mooring system in a mooring state with maximum backward offset.

FIG. 7 illustrates a maximum backward offset, and shows how the bow mooring restrictor 34 has been elevated above the water surface S, while the stern mooring restrictor 44 has sunk deeper into the water.

Figure 8:
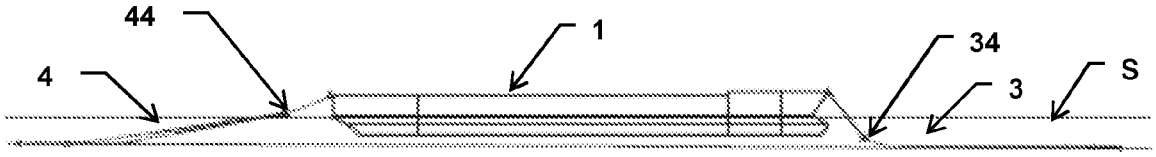
FIG. 8 is a side view schematic sketch illustrating the invented mooring system in a mooring state with maximum forward offset.

FIG. 8 illustrates a maximum forward offset, and shows how the stern mooring restrictor 44 has been elevated above the water surface S, while the bow mooring restrictor 34 has sunk deeper into the water.

Figure 9:
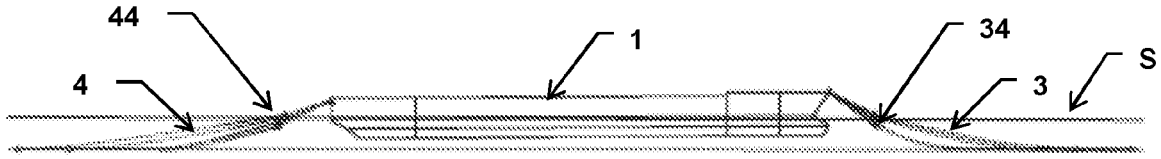
FIG. 9 is a side view schematic sketch illustrating the invented mooring system in a mooring state in maximum sideways tension.
Figure 10:
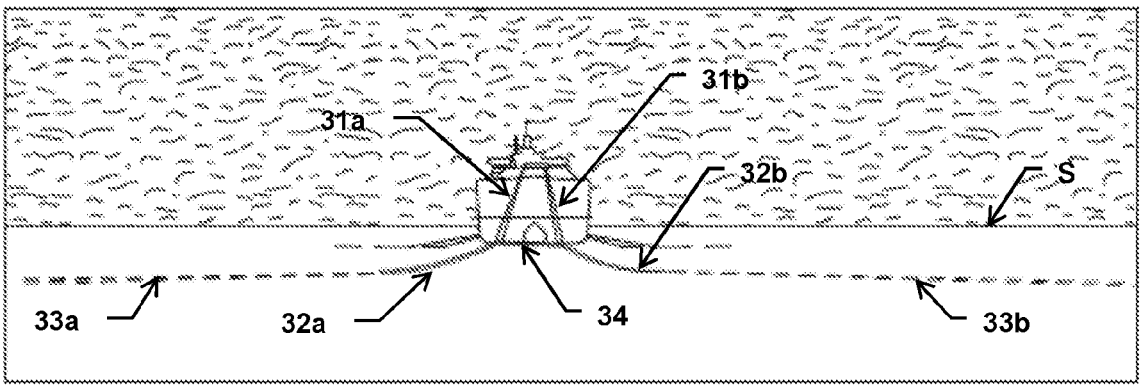
FIG. 10 is a front view of an embodiment of the invented mooring system, in use for mooring a floating vessel, on a sideways (to starboard) offset state.

FIG. 9 and FIG. 10 illustrates the ship in a state of maximum sideways tension, but in equilibrium in the fore-aft direction.

Figure 11:
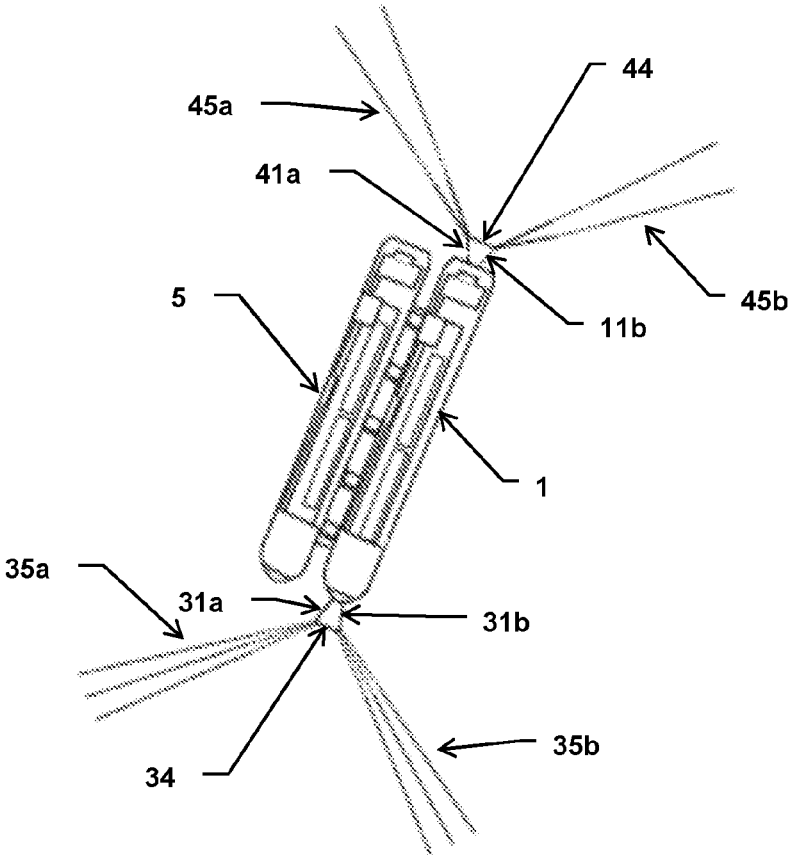
FIG. 11 is a plan view of an embodiment of the invented mooring system, in use for mooring a floating vessel, and also showing another vessel moored alongside the floating vessel.

FIG. 11 shows a ship (e.g. an FRSU ship) 1 moored with a bow mooring system 3 and a (stern) hold-back system 4, and a ship 5 (e.g. an LNGC) moored alongside.

Figure 12:
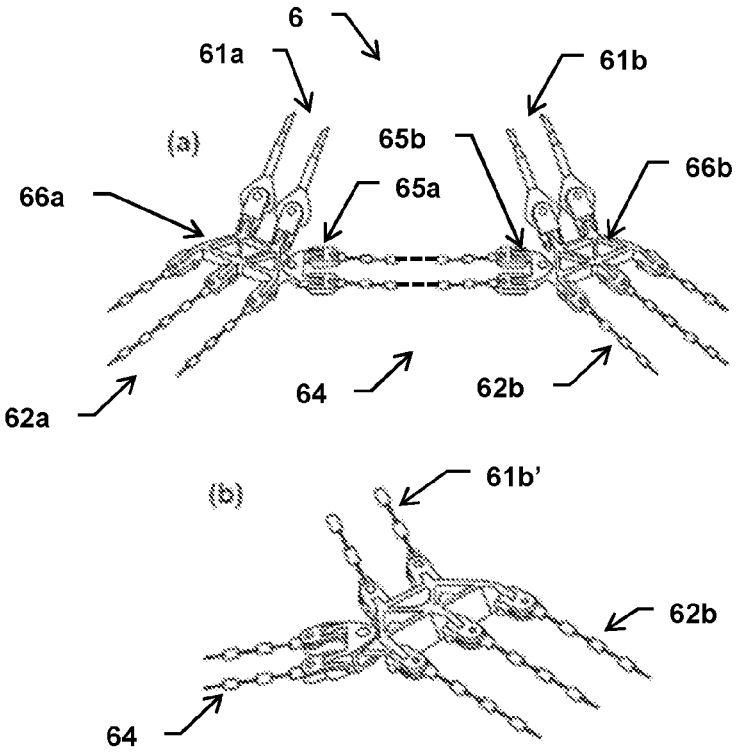
FIGS. 12*a* and 12*b* are perspective views illustrating alternative embodiments of the mooring restrictor. The dotted lines indicate that the mooring restrictor chains are interconnected and may have a length that suit the applicable configuration.

Referring to FIGS. 12*a* and 12*b*, the mooring restrictors (bow and/or stern) may in other embodiments comprise one or more chains, wires or ropes, but a stiff connection which is considered to be more durable. Here, the mooring system 6 comprises upper mooring elements 61*a,b* that at one end are connected to the ship's bow portion or stern portion and at the other end are connected to a mooring restrictor 64. Lower mooring elements 62*a,b* are connected between the mooring restrictor 64 and respective seabed anchors (not shown) and extend in a catenary fashion in the body of water. It should be understood that this mooring system 6 may be used at the bow or at the stern, and that the number or chains and ropes may be dimensioned according to the applicable situation. The major difference between the mooring restrictors 34, 44 described above, and the alternative mooring restrictor 64, it that the latter comprises one or more chains (two shown in FIG. 12), which are rigid in tension. The mooring restrictor chains are at each end connected to end links 65*a,b*, which in turn are connected to respective mooring links 66*a,b*. The upper 61*a,b* and lower 62*a,b* mooring elements are connected to respective mooring links 66*a,b*.

The invention claimed is:

1. A mooring system, comprising:

a floating vessel having a bow mooring system and a stern mooring system, characterized in that:

the bow mooring system comprises:

a pair of first bow mooring elements connected at first ends to a bow portion of the floating vessel;

a pair of second bow mooring elements configured at first ends for connection to a seabed below a water surface; and a bow restrictor member connected between second ends of said pair of first bow mooring elements, said pair of second bow mooring elements connected to respective ends of the bow restrictor member; and the stern mooring system comprises:

a pair of first stern mooring elements connected at first ends to a stern portion of the floating vessel;

a pair of second stern mooring elements configured at first ends for connection to a seabed below a water surface; and a stern restrictor member connected between second ends of said pair of first stern mooring elements, said pair of second stern mooring elements connected to respective ends of the stern restrictor member, wherein the floating vessel is movable between a state of equilibrium and a maximum backward offset, and between the state of equilibrium and a maximum forward offset.

2. The mooring system of claim 1, wherein the pair of second bow mooring elements and/or second stern mooring elements comprise a first section comprising synthetic fibre ropes and a second section comprising chains that extend to the seabed.

3. The mooring system of claim 1, wherein the pair of first bow mooring elements and/or pair of first stern mooring elements comprise chains.

4. The mooring system of claim 1, wherein:

the bow and stern restrictor members are located below the water surface when the floating vessel is in a state of equilibrium;

the bow restrictor member is elevated to a level above the stern restrictor member when the floating vessel is in a maximum backward offset; and the stern restrictor member is elevated to a level above the bow restrictor member when the floating vessel is in a maximum forward offset.

5. The mooring system of claim 1, wherein the bow restrictor member and the stern restrictor member each comprise an inelastic member and the pairs of first and second bow mooring elements are connected to the bow restrictor member at opposite ends of the bow restrictor member.

6. The mooring system of claim 5, wherein the bow restrictor member and the stern restrictor member each have a length dimension between said ends that is less than or equal to a width of the floating vessel to which the mooring system is connected.

7. The mooring system of claim 1, wherein the bow restrictor member and the stern restrictor member each comprise a stiff member.

8. The mooring system of claim 1, wherein the bow restrictor member and the stern restrictor member each comprises one or more chains or ropes.

9. An assembly of floating vessels, comprising:

a first floating vessel comprising:

a bow mooring system and a stern mooring system, characterized in that:

the bow mooring system comprises:

a pair of first bow mooring elements connected at first ends to a bow portion of the first floating vessel;

a pair of second bow mooring elements configured at first ends for connection to a seabed below a water surface; and a bow restrictor member connected between second ends of said pair of first bow mooring elements, said pair of second bow mooring elements connected to respective ends of the bow restrictor member; and the stern mooring system comprises:

a pair of first stern mooring elements connected at first ends to a stern portion of the first floating vessel;

a pair of second stern mooring elements configured at first ends for connection to a seabed below a water surface; and a stern restrictor member connected between second ends of said pair of first stern mooring elements, said pair of second stern mooring elements connected to respective ends of the stern restrictor member, wherein the first floating vessel is movable between a state of equilibrium and a maximum backward offset, and between the state of equilibrium and a maximum forward offset; and a second floating vessel; characterized in that the first floating vessel and the second floating vessel are moored alongside each other.

10. The assembly of floating vessels of claim 9, wherein the first floating vessel is a Floating Storage and Regasification Unit (FSRU) ship, and the second floating vessel is a liquefied natural gas (LNG) carrier.

11. The assembly of floating vessels of claim 9, wherein the pair of second bow mooring elements and/or second stern mooring elements comprise a first section comprising synthetic fibre ropes and a second section comprising chains that extend to the seabed.

12. The assembly of floating vessels of claim 9, wherein the pair of first bow mooring elements and/or pair of first stern mooring elements comprise chains.

13. The assembly of floating vessels of claim 9, wherein:

the bow and stern restrictor members are located below the water surface when the first floating vessel is in a state of equilibrium;

the bow restrictor member is elevated to a level above the stern restrictor member when the first floating vessel is in a maximum backward offset; and the stern restrictor member is elevated to a level above the bow restrictor member when the first floating vessel is in a maximum forward offset.

14. The assembly of floating vessels of claim 9, wherein the bow restrictor member and the stern restrictor member each comprise an inelastic member and the pairs of first and second bow mooring elements are connected to the bow restrictor member at opposite ends of the bow restrictor member.

15. The assembly of floating vessels of claim 14, wherein the bow restrictor member and the stern restrictor member each have a length dimension between said ends that is less than or equal to a width of the first floating vessel to which the bow mooring system is connected.

16. The assembly of floating vessels of claim 9, wherein the bow restrictor member and the stern restrictor member each comprise a stiff member.

17. The assembly of floating vessels of claim 9, wherein the bow restrictor member and the stern restrictor member each comprises one or more chains or ropes.

* * * * *